US007322346B2

(12) United States Patent
Schreurs et al.

(10) Patent No.: US 7,322,346 B2
(45) Date of Patent: Jan. 29, 2008

(54) METHOD AND DEVICE FOR ENGINE CONTROL IN A MOTOR VEHICLE

(75) Inventors: Bart Hubert Schreurs, Athus (BE); Julien Schmitt, Yutz (FR)

(73) Assignee: Delphi Technologies, Inc., Troy, MI (US)

( * ) Notice: Subject to any disclaimer, the term of this patent is extended or adjusted under 35 U.S.C. 154(b) by 142 days.

(21) Appl. No.: 11/264,445

(22) Filed: Nov. 1, 2005

(65) Prior Publication Data

US 2006/0130820 A1 Jun. 22, 2006

(30) Foreign Application Priority Data

Dec. 17, 2004 (DE) ..... 10 2004 061 462

(51) Int. Cl.
*F02D 41/14* (2006.01)

(52) U.S. Cl. ..... 123/696; 701/109; 123/674

(58) Field of Classification Search ..... 701/104, 701/109; 123/672, 674, 696
See application file for complete search history.

(56) References Cited

U.S. PATENT DOCUMENTS 4,625,698 A * 12/1986 Jamrog ..... 123/696
6,102,018 A * 8/2000 Kerns et al. ..... 123/674
6,298,840 B1 * 10/2001 Kerns ..... 123/681
6,357,431 B1 * 3/2002 DeGroot et al. ..... 123/694

* cited by examiner

*Primary Examiner*—Erick Solis
(74) *Attorney, Agent, or Firm*—Patrick M. Griffin

(57) ABSTRACT

A method is specified for controlling a combustion engine in a motor vehicle, namely for optimally adjusting an air/fuel ratio which is distinguished in that the air/fuel ratio is the result of a regulation process. Individual aspects of the invention further address a regulation method particularly suitable for such regulation in consideration of the available input values and readings. For the purposes of supporting regulation, an adaptation method is specified which can also be used independently of the regulation method or with other regulation methods and which enables the regulation to be continuously adapted to the respective operating conditions, such as, for example, the engine operational performance, and signs of wear and tear and disruptions due to deposits etc. which accompany it.

11 Claims, 7 Drawing Sheets

METHOD AND DEVICE FOR ENGINE CONTROL IN A MOTOR VEHICLE

Figure 1:
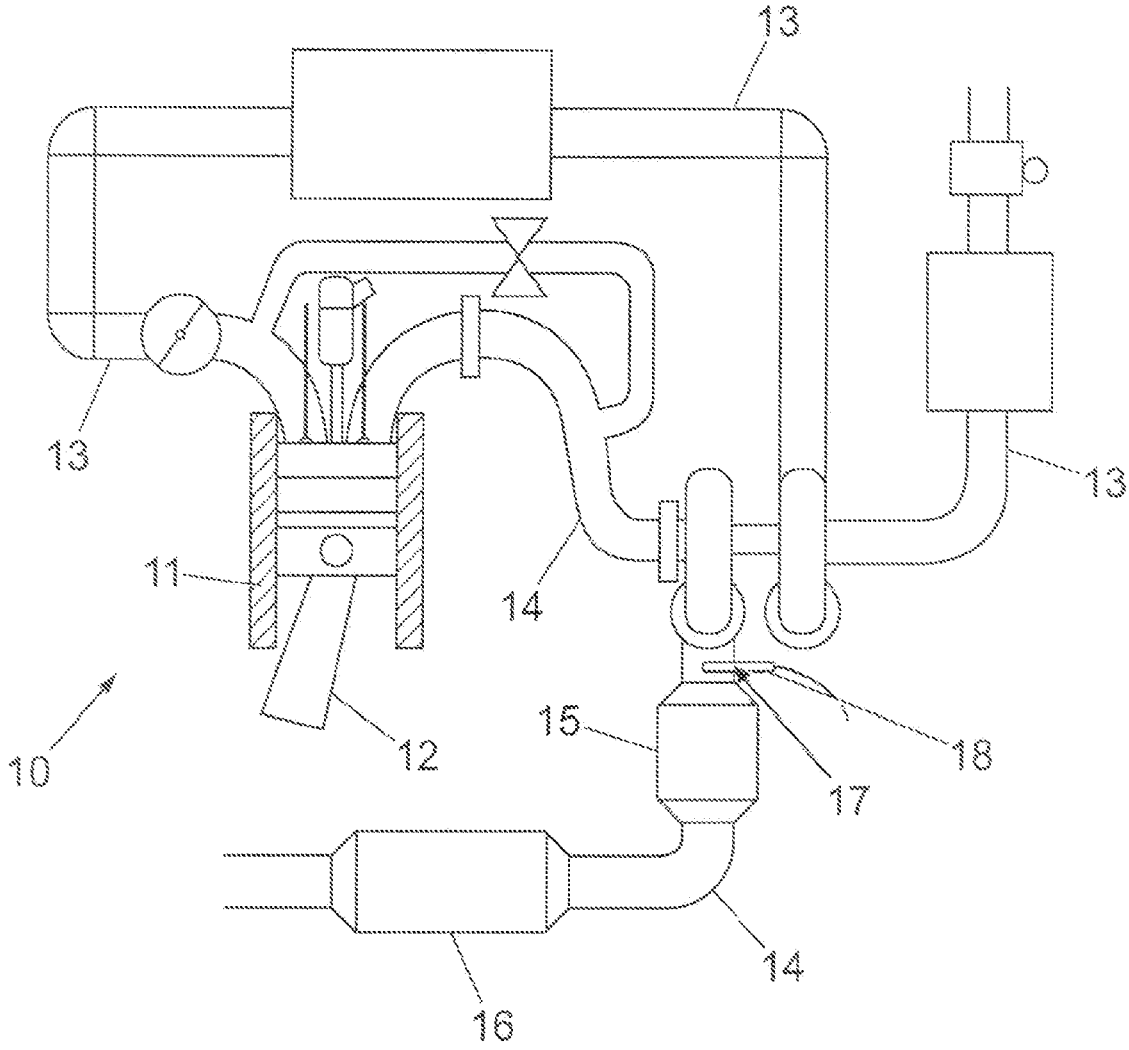
PRIOR ART Fig. 1

Exemplary embodiments of the present invention relates to a method of engine control, more particularly a method for controlling the fuel/air ratio in a motor vehicle. Exemplary embodiments of the present invention further relate to a control device which can be integrated into the engine electronics of a combustion engine or can be realized as a separate control device.

Controlling the fuel/air ratio is known per se. Exemplary embodiments of the present invention suggests a method for regulating this ratio instead of the control in order to achieve better results with regard to energy use and with regard to unavoidable exhaust gas production, where "regulating" is used in the sense of closed-loop control and "control" is used in the sense of feed-forward or open-loop control. An optimal fuel/air ratio is namely accompanied by minimal pollutant production.

Further aspects of the invention deal with adaptation methods which enable optimal regulation of the fuel/air ratio even in varying conditions, e.g. due to the duration of operation of the combustion engine. In addition, the adaptation should make it possible to quickly adapt the regulating method to different vehicle and engine types.

Exemplary embodiments of the invention consists in improving the adjustment of the fuel/air ratio.

Exemplary embodiments of the invention and other preferred embodiments will be described hereafter in greater detail with reference to the drawings. Corresponding objects or elements are given the same reference numbers in all figures.

In the drawing

Figure 2:
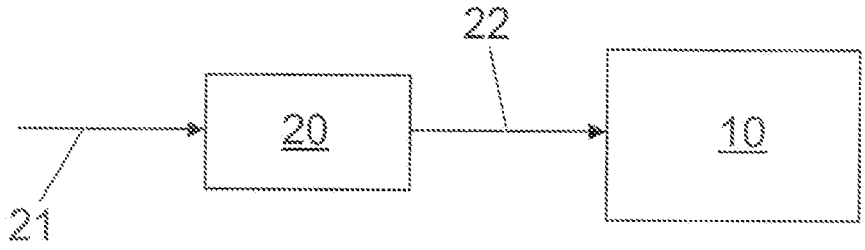
PRIOR ART Fig. 2
Figure 3:
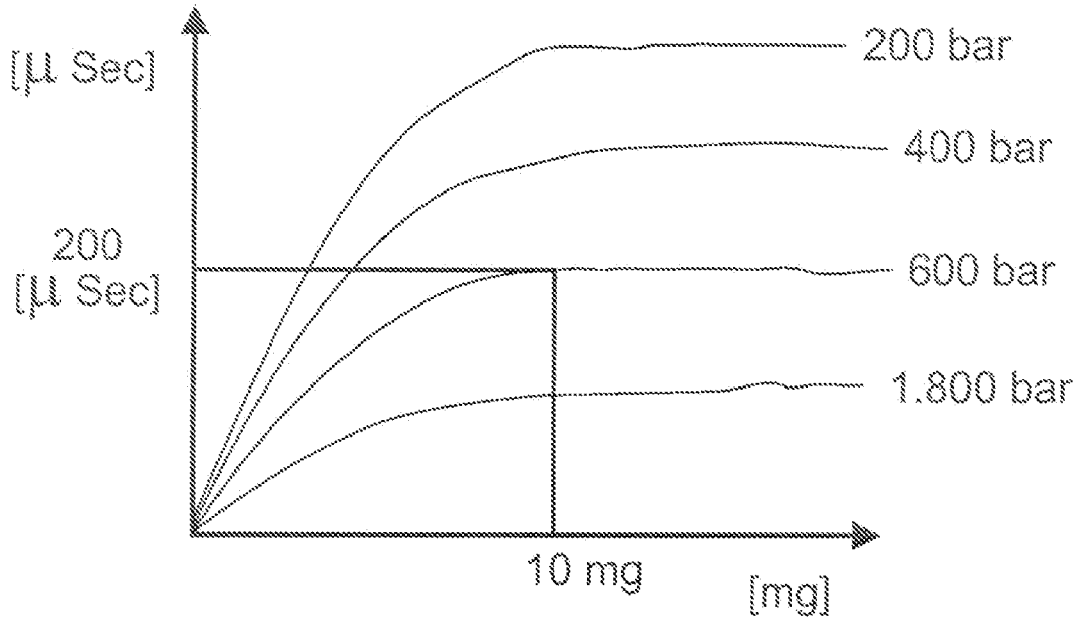
PRIOR ART Fig. 3
Figure 4:
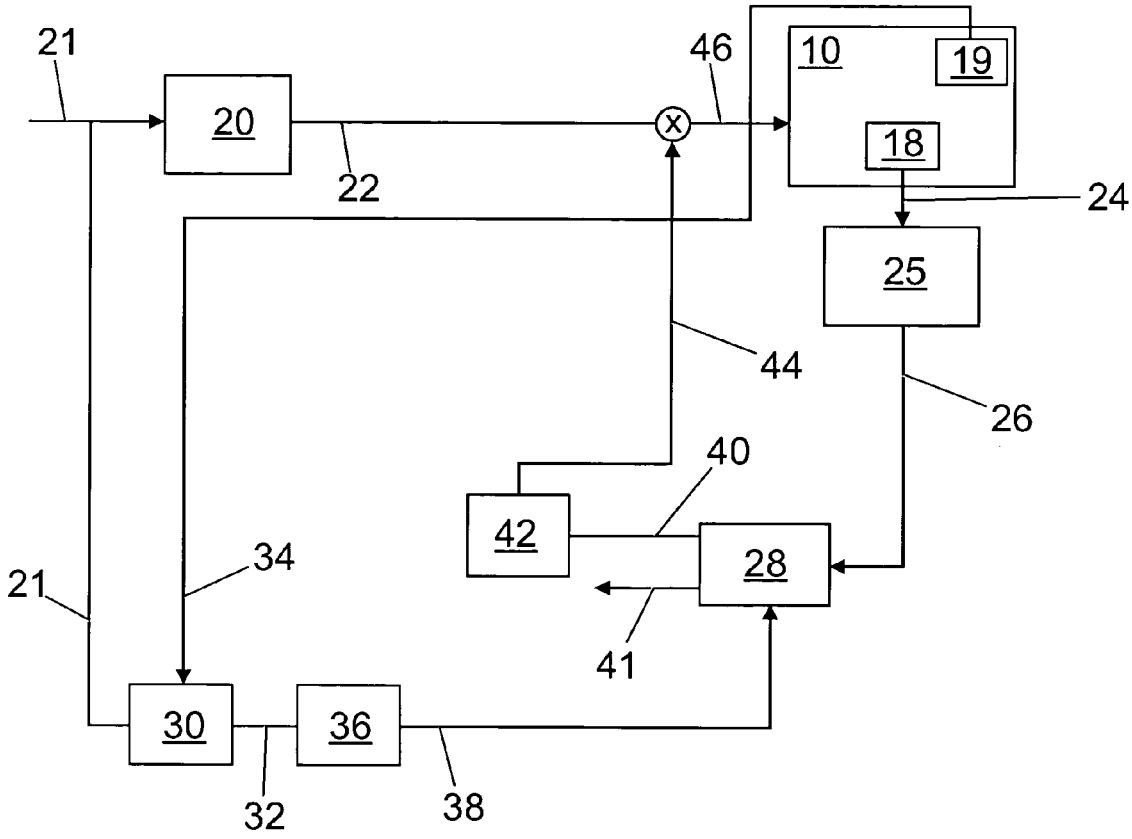
Figure 5:
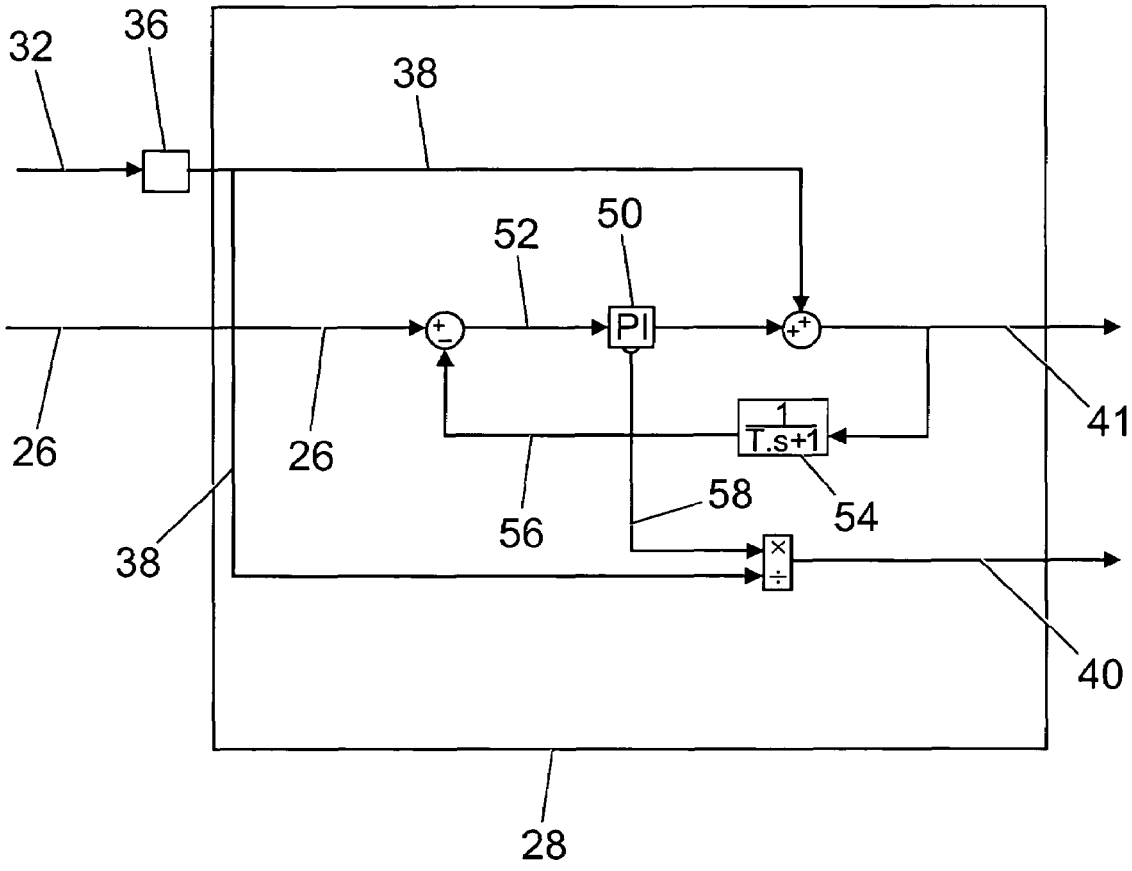
Figure 6:
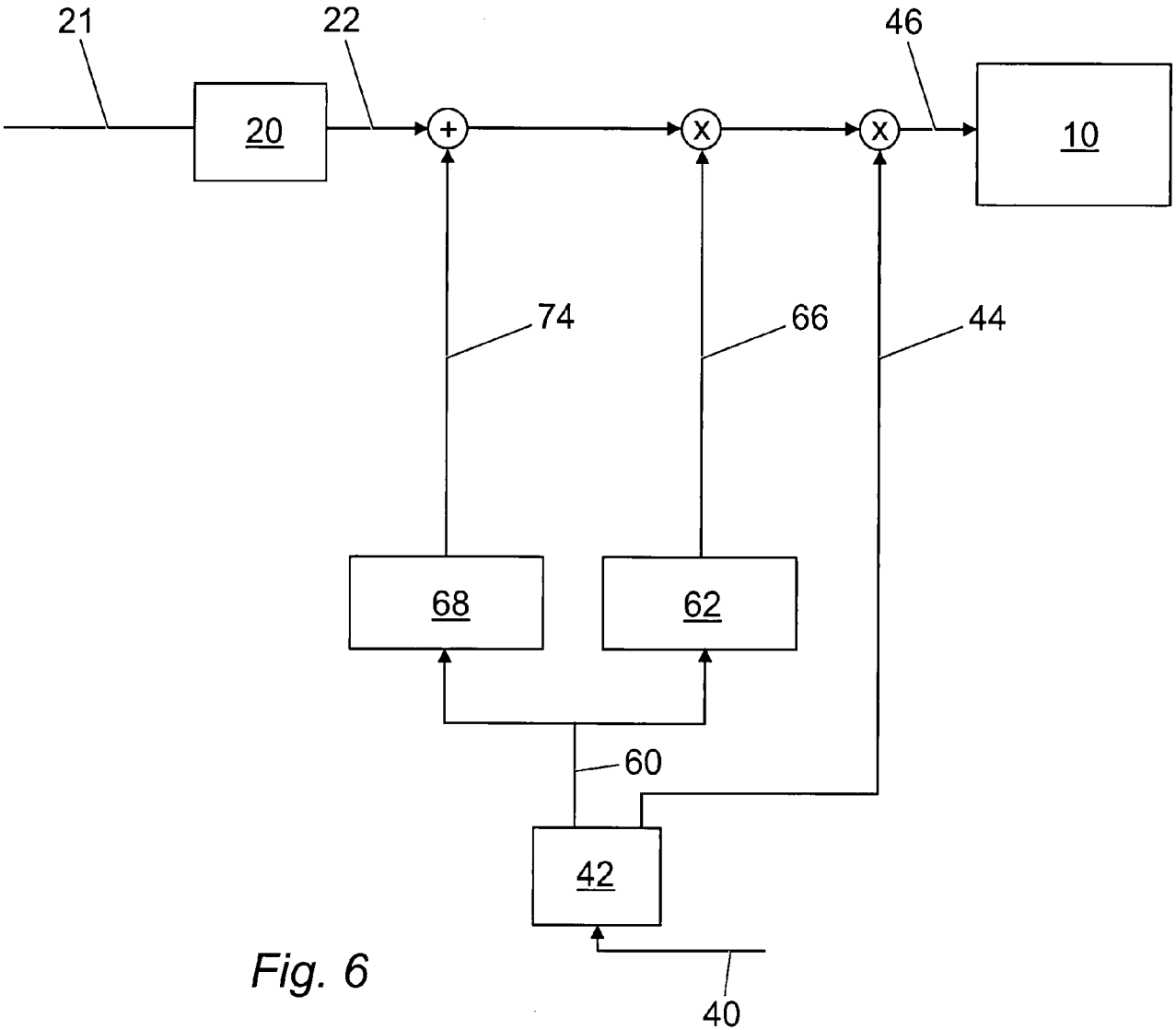
Figure 7:
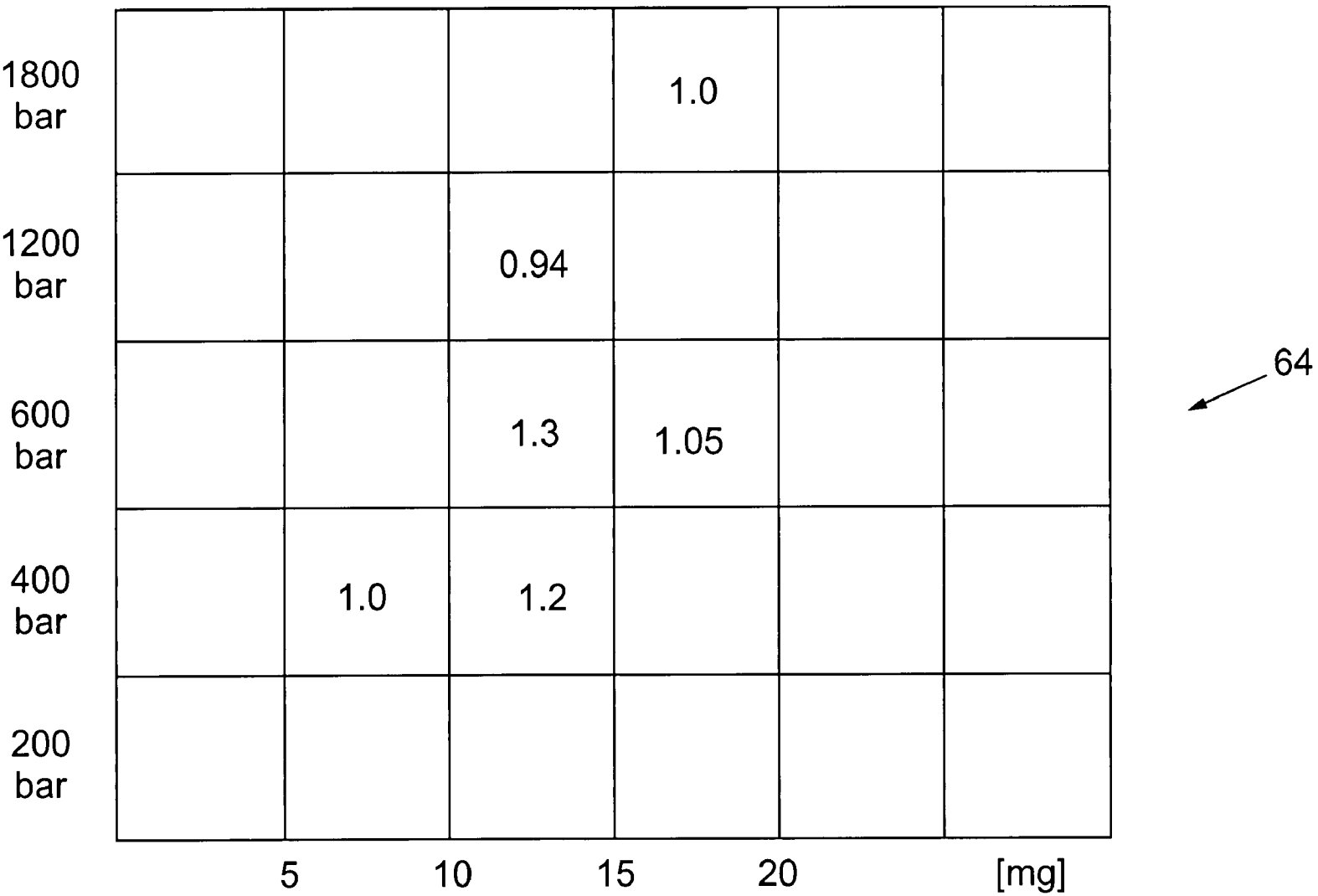
Figure 8:
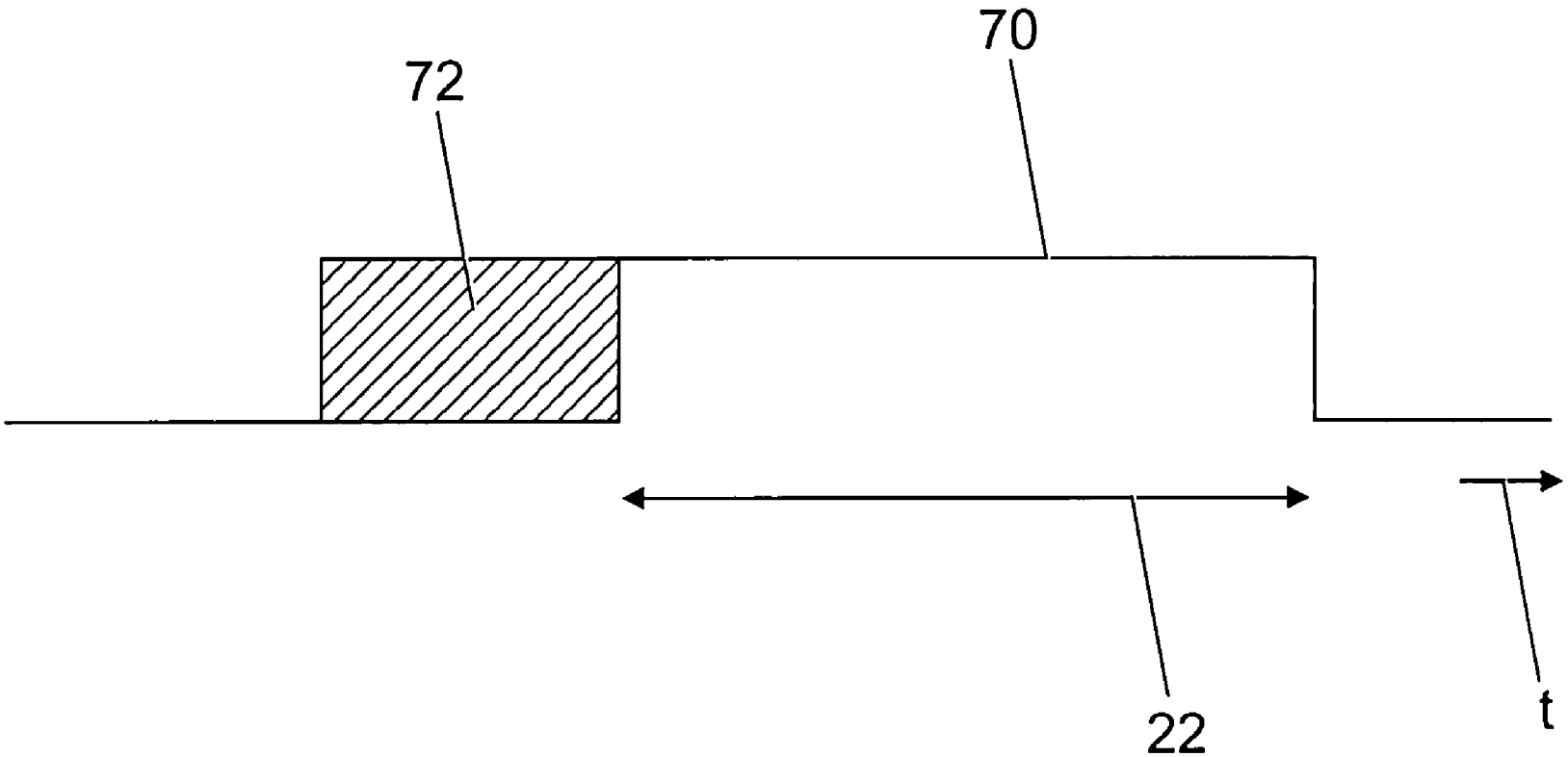

FIG. 1 is a schematically simplified depiction of a combustion engine,

FIG. 2 is a block diagram for a pulse duration control for triggering (opening) a fuel injector, FIG. 3 is a family of characteristics with different injection pressures, from which family the appropriate injection time or injection duration can be established for a known amount of propellant for the respective injection pressure, FIG. 4 is a block diagram for regulating the pulse duration for triggering a fuel injector, FIG. 5 is a function block from the block diagram in FIG. 4 with additional details, FIG. 6 is a block diagram for a device for carrying out adaptation processes for supporting and optimising regulation, FIG. 7 is an adaptation matrix provided for use in adaptation and FIG. 8 is a graphic depiction of an injection pulse with a preliminary offset portion, FIG. 1 schematically shows a depiction of a combustion engine 10, as it is used for motor vehicles, in the example of a diesel engine. The combustion engine 10 includes, in a manner known per se, at least one cylinder 11 with the piston 12 functioning therein as well as an air exchanger system 13 and an exhaust gas evacuation system 14. The exhaust gas evacuation system 14 includes, also in a manner known per se, for example a catalytic converter 15 and a filter 16. A possible position of an oxygen sensor 18 in the exhaust gas evacuation system 14 is indicated in FIG. 1 by an arrow 17, this sensor being referred to, since the value provided by the oxygen sensor 18 is used in order to establish the actual oxygen/fuel ratio in the engine 10, according to the corresponding English acronym (AFR=air/fuel ratio) as AFR sensor 18 or, in the case of a wide-range oxygen sensor 18, as WRAF sensor 18 (WRAF=wide range air/fuel). The basis for this description lies in the fact that the air/fuel ratio during combustion can be established from the oxygen portion in the exhaust gas. A MAF sensor 19 (maf=mass air flow) is shown in the air exchanger system 13 as a further sensor which provides a measurement for the air mass in the combustion engine 10 or in the individual cylinder 11.

Hitherto known engine control methods provide an algorithm, implemented in the engine control, for calculating the duration of injection pulses, as schematically depicted in FIG. 2. The algorithm is referred to below, succinctly, as injection duration calculation 20 for the purpose of referencing. A value for the instantaneously necessary fuel amount is applied to the algorithm as input signal 21. Thus, and using a table furnished in the engine control or a corresponding family of characteristics, which goes/go back to connections between fuel amounts, injection pressure and pulse duration, as they are shown in the graphic in FIG. 3, the injection duration calculation 20 can calculate the duration of a pulse for triggering the respective fuel injector in the combustion engine 10, which is depicted in FIG. 2 only as a function block 10. The respectively established pulse duration 22 is accordingly depicted as an output of the injection duration calculation 20 and as an input for the combustion engine 10.

By way of an example, FIG. 3 shows a family of characteristics for different injection pressures, i.e. for example 200 bar, 400 bar, etc. In the case of so-called "common rail systems" these pressure values are the so-called "rail pressure". The fuel amount per stroke of the piston is plotted in milligrams (mg) on the abscissa and the respective pulse duration in microseconds is plotted on the ordinate. Depending on the instantaneous injection pressure, the appropriate pulse duration is established by means of the ordinate using the respective appropriate graph of the family of characteristics from the required fuel amount which is to be plotted using the abscissa, as is shown, by way of example, for a required fuel amount of 10 mg, which requires a pulse duration of 200 microseconds at an injection pressure of 600 bar. This is carried out automatically and continuously in the injection duration calculation 20 using a suitable algorithm which accesses a suitable storage of the data shown in FIG. 3.

Instead of the hitherto known mere control of pulse duration, as depicted in FIG. 2, the invention suggests regulation of the pulse duration for triggering the respective fuel injectors as is explained below using the other figures.

Using a schematically simplified block diagram, FIG. 4 shows a first exemplary embodiment of the invention, namely the regulation of the air/fuel ratio by suitably governing the pulse duration 22 using a reading 24 supplied by the WRAF sensor 18. This reading is processed by means of preprocessing 25. A corresponding numerical value is thereby formed, by means of A/D conversion for example, from the current intensity signal or voltage signal, supplied by the WRAF sensor 18, which is additionally filtered or smoothed where necessary. There is then available, at the output of preprocessing 25, a value which is referred to below as "measured" air/fuel ratio 26 or, in accordance with the above-mentioned abbreviations, as MAFR (measured air fuel ratio) 26. The MAFR value is fed to an AFR observer 28 (AFR=air/fuel ratio).

A further input for the AFR observer 28 is derived from the instantaneously necessary fuel amount 21. For this purpose, the air/fuel ratio is calculated in an AFR calculation 30 using the fuel amount 21 and the respective air mass in the cylinder 11 and is provided as output value 32 for further processing. The AFR calculation is based on the air mass in cylinder 11, i.e. not on the constant air volume but rather on the air mass which varies depending on the ambient situation (temperature, ambient pressure). A value for the respective air mass is fed to the AFR calculation 30 as an input value 34 from the MAF sensor 19 (MAF=mass air flow) in the combustion engine 10. Preferably, this input value 34 is based on the speed density (unit: [g/s]) of the mass flow of the fresh air which is taken in.

The output value 32 can also be referred to as the AFR command and is subjected to preprocessing in a model 36 for reproducing the dynamics of the combustion process and the reaction time of the WRAF sensor 18. In particular, possible operating times, which arise from the position of the WRAF sensor 18 in the exhaust gas evacuation system 14, are thereby considered (cf. FIG. 1). The greater the distance between the WRAF sensor 18 and the actual combustion location, i.e. the combustion chamber in cylinder 11, the greater the consideration which must be given, using model 36, to the execution time which is correlated with the duration required by the exhaust gas to reach the WRAF sensor 18 after combustion. A value is thus available at the output of the model 36, whereby said value is fed to the AFR observer 28 as a delayed AFR command 38 or DAFR command 38.

In the theoretical ideal case both input signals of the AFR observer 28, i.e. MAFR (measured air fuel ratio) 26 and DAFR command 38 should correspond. In practice and in the operation of the combustion engine 10, there is normally no such correspondence. The remaining difference between the two input values of the AFR observer 28 is compensated by means of a PI controller which is linked to AFR observer 28 and which is not depicted separately in FIG. 4. The PI controller, which is linked internally to the AFR observer 28, is thus used to bring the DAFR command 38 into coincidence with the MAFR 26. The I portion of the PI controller linked to the AFR observer 28 is, if necessary, divided by the respective instantaneous value of DAFR 38, outputted as estimated AFR "error" 40 and fed to an AFR controller 42 which is preferably also realised as a PI controller. In contrast to customary configurations, no error signal, for example in the form of the absolute difference between MAFR 26 and DAFR command 38, but rather the I portion of an upstream controller, is fed to the AFR controller 42. This aspect of the invention is viewed as an aspect having its own inventive quality. The output 44 of the AFR controller is multiplicatively linked with the pulse duration 22 and is fed to the combustion engine 10 or the respective fuel injector as a corrected pulse duration 46. The AFR observer 28 supplies the estimated air/fuel ratio 41 as a further output value.

A more detailed depiction of the AFR observer is shown in FIG. 5. The internal PI controller 50 of the AFR observer 28 is also depicted in FIG. 5. As previously described, the internal PI controller 50 is provided to compensate for any possible differences between MAFR 26 and DAFR command 38. The input 52 of the internal PI controller thus represents the WRAF estimation error which is formed before the internal PI controller by subtracting a WRAF estimated value 56, which is obtained using a WRAF sensor model 54, from MAFR 26. The tap of the I portion of the internal PI controller 50, which is divided by the DAFR command 38 for the purposes of standardisation, is shown by 58. Overall, there emerges, after this division, the estimated AFR error 40, which in the case of the previously described division can also be referred to as relative AFR error 40. The use of only the I portion of the internal PI controller 50 corresponds to a low-pass filtering of the error between the estimated AFR 56 and MAFR 26.

The regulation of the pulse duration for triggering the fuel injectors using the AFR controller 42 causes it to be the case that when:

relative AFR error 40>0 (greater than "0"), i.e. when the actual AFR (air/fuel ratio) is greater than the required/requested AFR, that the correction value 44 outputted from the AFR controller 42 is smaller than "1.0" and that the pulse length for the opening times of the fuel injectors is accordingly shortened through multiplication with the correction value 44;

relative AFR error 40=0 (equal to "0"), i.e. when the actual AFR is equal to the required/requested AFR, that the correction value 44 outputted from the AFR controller 42 is equal to "1.0" and that the pulse length for the opening times of the fuel injectors accordingly remains unchanged;

relative AFR error 40<0 (less than "0"), i.e. when the actual AFR is less than the required/requested AFR, that the correction value 44 outputted from the AFR controller 42 is greater than "1.0" and that the pulse length for the opening times of the fuel injectors is extended accordingly.

The regulation of the pulse duration for triggering the fuel injectors as described above is referred to as "fast regulation". In addition to this fast regulation, i.e. in a complementary manner or, if applicable, also autonomously and independently thereof, an adaptation method for altering the pulse durations for triggering the fuel injectors is suggested which also has autonomous inventive quality. For the purpose of referencing, the adaptation method or the use thereof is accordingly referred to as "slow regulation", in order to differentiate it from "fast regulation".

The adaptation method is further illustrated using FIG. 6. FIG. 6 is depicted as a cut-out from FIG. 4 and accordingly shows the AFR controller 42, the injection duration calculation 20 and the combustion engine 10. The elements from FIG. 4 which are not depicted in FIG. 6 are only omitted for reasons of clarity.

In an analogous manner to the previously described situation with regard to the AFR observer 28, only the I portion 60 of the AFR controller 42 is used for the adaptation method. The low-pass characteristic of the I portion of the controller is used once again, in order to carry out the adaptation substantially on the basis of longer lasting errors.

The invention provides two basically independent adaptation methods, i.e. adaptation methods which can be used alternatively or in combination. One of the adaptation methods is referred to as "multiplicative learning" for the purpose of referencing and the other adaptation method is referred to as "starting point learning" or "offset learning".

Multiplicative learning, which is carried out using a first function block 62 provided for it, is firstly described in greater detail. The tap of the I portion 60 of the AFR controller 42 is the input signal of the first function block 62. Depending on whether this I portion is less than zero, equal to zero or greater than zero, suitable amendments are carried out in an adaptation matrix 64 which is depicted in FIG. 7 by way of example.

FIG. 7 shows the adaptation matrix 64, of which the columns represent an injection pressure in bar and of which the rows represent a fuel amount in mg per hub stroke. A neutral value is stored in each cell of the adaptation matrix 64 at the beginning of the adaptation method, whereas in a later multiplicative consideration of the result of the adaptation process the value "1.0", for example, is stored.

Depending on the operating situation, i.e. depending on the injection pressure, for example, the respectively relevant cell or row of the adaptation matrix 64 is selected. The specific cell in the selected row is selected using the instantaneously necessary fuel amount 21. The numerical value of the adaptation matrix cell selected in this manner is now changed according to the following formula:

If the tap of the I portion 60 of the AFR controller 42 is <1 (less than "1.0")

the instantaneous numerical value of the selected cell, which is referred to here as "x", is decreased by, for example, carrying out a division or subtraction according to the following formula:

$x:=x*k;\ k<1$, e.g. $k=0.99$ or $x:=x+k;\ k<0$, e.g. $k=-0.01$

>1 (greater than "1.0")

the instantaneous numerical value of the selected cell is increased by, for example, carrying out a multiplication or addition according to the following formula:

$x:=x*k;\ k>1$, e.g. $k=1.01$ or $x:=x+k;\ k>0$, e.g. $k=+0.01$

The respective numerical value of the cell linked to the respective operating situation is multiplicatively linked with the established pulse duration 22 at output 66 of the first function block 62. The respective numerical value is a value in the order of "1.0", i.e. at a numerical value greater than "1.0", the pulse duration is extended by the adaptation method, whereas at a numerical value less than "1.0" the pulse duration is shortened accordingly by the adaptation method.

Above all, the adaptation method has the advantage that conditions in the engine which have been changed by the adaptation, such as signs of wear and tear and the like for example, can be taken into consideration and can be compensated for. Insofar as this would also be possible by means of regulation using the AFR controller 42, this at least basically has the undesired effect that the AFR controller must be constantly active in order to compensate for permanent errors. It would, however, be desirable if the output 44 of the AFR controller always remains near "1.0" when in continuous operation, i.e. the AFR controller 42 itself hardly engages. This is possible if a potential error can be steadily decreased as a result of adaptation so that the AFR error 40 thus remains small. In the case of small or disappearing AFR error 40, the output 44 of the AFR controller 42 remains in the region of the desired value "1.0" such that the dynamics of the overall system are optimised by minimising the influence of the AFR controller 42 on this dynamic.

With regard to the method described above for changing the numerical values of the respectively relevant cells of the adaptation matrix 64, minimum and maximum values can be considered such that the numerical value of a cell is not permitted to fall below or exceed the respective minimum or maximum values or the minimum or maximum values which are specified for individual rows of the adaptation matrix 64 or for the adaptation matrix 64 as a whole. Sensible minimum and maximum values are, for example, "0.8" or "0.9" and "1.1" or "1.2" respectively. Of course, depending on the situation, i.e. engine type or vehicle type, for example, other minimum and maximum values, which differ from "1.0" by more than 10% or 20%, come into consideration.

Some example values are entered into the adaptation matrix 64 in FIG. 7 purely by way of illustration. In the operation of the combustion engine 10 or in the case of operation of a vehicle with the combustion engine 10, the numerical values in the adaptation matrix are continually adapted.

As an alternative to or in addition to Multiplicative Learning with the adaptation matrix 64 and the first function block 62, the use of a further adaptation process comes into consideration, namely "Offset Learning". It is thereby taken into account that the pulse for triggering the injection valves always has substantially the same amplitude, but that for an injection valve reaction, i.e. the actual opening of the injection aperture, depending on the operating situation and particularly depending on the prevailing pressure ratios, the availability of the pulse for a certain time (offset) is necessary until the injection valve reacts and actually opens the injection aperture. This is depicted in FIG. 8 by way of example, whereby a pulse 70 for triggering the fuel injector is shown with a duration corresponding to the established pulse duration 22. If a noteworthy portion of the pulse duration 22 elapses until the fuel injector opens, the actual opening time of the fuel injector is shorter than the established pulse duration 22. The accessed fuel amount is then unable to reach the actual necessary fuel amount. Attempts are made to compensate for this by lengthening the pulse duration, i.e. by starting the pulse earlier such that the injection valve is opened synchronously with the engine pulse and remains opened exactly for the established pulse duration 22. The overall lengthening of the pulse 70 by an offset portion 72 can vary and is depicted in FIG. 8 merely by way of example.

It is important that the adaptation process of Offset Learning is preferably carried out only in certain operating situations of the combustion engine, i.e., for example, only in the case of a low load (low torque delivered) and/or in the case of idle speeds or in the case of speeds in the region of the idle speed, referred to collectively as "low load", and upon obtaining the limit or threshold value in the case of Multiplicative Learning. On the one hand, there arises in the case of low load the need for comparably large offset portions 72 of the pulse 70. On the other hand Offset Learning should preferably be used if compensation with Multiplicative Learning does not lead to the desired results. The duration of the offset portion 72 of the pulse 70 is established within the framework of Offset Learning according to the subsequently described formula:

A specified or specifiable initial duration of the offset portion 72 is assumed. Depending on the instantaneous value of the tap of the I portion 60 of the AFR controller 42, i.e. depending on the input signal for the Offset Learning, this initial duration is multiplicatively or additively acted upon with a constant factor or summand. Thus, if the duration of the offset portion 72 of the pulse 70 is referred to as y, there arises, for example,—in a situation which is analogous to that in the case of Multiplicative Learning above—the following connection in the form of a formula:

If the tap of the I portion 60 of the AFR controller 42 is <1 (less than "1.0")

the instantaneous duration of the offset portion 72 of the pulse 70 is decreased by carrying out, for example, a division or subtraction in accordance with the following formula:

$y:=y*r;\ r<1$, e.g. $r=0.99$ or $y:=y+r;\ r<0$, e.g. $r=-0.01$

>1 (greater than "1.0")

the instantaneous duration of the offset portion 72 of the pulse 70 is increased by carrying out a multiplication or addition, for example, in accordance with the following formula:

$y:=y*r;\ r>1$, e.g. $r=1.01$ or $y:=y+r;\ r>0$, e.g. $r=+0.01$

In order to adapt the duration of the offset portion 72 of the pulse 70 to different injection pressures, it can preferably be arranged that above-mentioned initial value and the instantaneous value y which is established from it initially does not directly represent a time value, but rather a "fuel amount". Using the table already available to the engine electronics to map fuel amounts in respect of injection durations as shown in FIG. 3, a "fuel amount" adapted during Offset Learning can be mapped in respect of a duration of the offset portion 72 of the injection pulse 70 in a particularly elegant and efficient manner. It is even possible to scale the "learned value" in each case with regard to the respective injection pressure by using different characteristic graphs for the different injection pressures. The learning of only one numerical value is thus necessary overall in the case of Offset Learning.

If the numerical value directly represents a time value, scaling can also be carried out using specified or specifiable scaling factors, but in this case the non-linear connection between the fuel amount and the pulse duration necessary for it cannot be mapped to as high a standard.

The change in the numerical value adapted in Offset Learning can also be limited by suitably chosen limits.

The offset learning is carried out by means of a second function block 68 which realises the functionality described above, is arranged parallel to the first function block 62, and to which the tap of the I portion 60 of the AFR controller 42 is fed as the input signal. The output signal of the second function block is a time value 74 which is added to the established pulse duration 22.

An adaptation of the regulating method to different engines and vehicles is also possible, in that an adaptation matrix 64 is maintained for each of such engines and vehicles, this adaptation matrix not being defaulted in all cells with the neutral value e.g. "1.0" but rather has, in individual cells, values which differ from the neutral value and which arise as experimental values or as a result of appropriate calculations. The respective engine can then operate with an adaptation method of which the parameters are already the result of "prior training". The optimal operating situation of the engine is achieved more quickly in this manner because individual sections of the adaptation, of the "training", have already been anticipated.

The first and the second function blocks 62, 68 represent an algorithm which is preferably implemented in the engine electronics. The implementation of the respective algorithms is particularly preferably carried out as a software task such that the respective algorithm can be accessed in a set time-pattern. A set time-pattern, i.e. equidistant access times, has the advantage that instability or oscillating is avoided as soon as possible.

In short, the invention can be represented as follows:

A method is specified for controlling a combustion engine 10—engine control—in a motor vehicle, namely for optimally adjusting an air/fuel ratio which is distinguished in that the air/fuel ratio is the result of a regulation process. Individual aspects of the invention further address a regulation method particularly suitable for such regulation in consideration of the input values and readings available. For the purposes of supporting regulation, an adaptation method is specified which can also be used independently of the regulation method or with other regulation methods and which enables the regulation to be continuously adapted to the respective operating conditions, such as, for example, the engine operational performance, and signs of wear and tear and disruptions due to deposits which accompany it.

The invention claimed is:

1. A method of controlling an internal combustion engine comprising:

adjusting an air fuel ratio by:

obtaining a wide range air fuel ratio estimation error by subtracting a wide range air fuel ratio estimated value from a measured air fuel ratio;

passing the wide range air fuel ratio estimation error to a Proportional Integral controller;

calculating an air fuel ratio error based on an integral portion of the Proportional Integral controller; and regulating a pulse duration of a fuel injector based on the air fuel ratio error.

2. The method of claim 1, wherein the air fuel ratio error is based on the integral portion of the Proportional Integral controller combined with a delayed air fuel ration command.

3. The method of claim 1, wherein the pulse duration of the fuel injector is decreased if the air fuel ratio error is greater than zero.

4. The method of claim 1, wherein the pulse duration of the fuel injector is unchanged if the air fuel ratio error is zero.

5. The method of claim 1, wherein the pulse duration of the fuel injector is increased if the air fuel ratio error is less than zero.

6. The method of claim 1, further comprising:

passing the air fuel ratio error to at least one of a first function block and a second function block; and adapting a pulse duration of the fuel injector based on an output from the at least one first and second function blocks.

7. The method of claim 6, further comprising:

linking an adaptation matrix to the one of the first and second function blocks, said adaptation matrix including individually combinations of operational parameters regarding a required fuel amount and injection pressure for a particular engine;

calculating a correction factor based on the adaptation matrix; and controlling the pulse duration of the fuel injector based upon the correction factor.

8. The method of claim 1, further comprising:

calculating an offset value to account for lags in opening times for the fuel injector; and controlling the fuel injector based on the offset value.

9. A device for controlling a combustion engine comprising:

a wide range air fuel ratio sensor for detecting an estimated wide range air fuel ratio;

a preprocessor coupled to the wide range fuel ratio sensor, said preprocessor calculating a wide range air fuel ratio estimation error based on a measured air fuel ratio and the estimated wide range air fuel ratio;

a proportional integral controller linked to the preprocessor, said proportional integral controller receiving the wide range air fuel ratio estimation error and outputting through an integrating output an air fuel ratio error; and a controller operatively connected to the proportional integral controller and a fuel injector, said controller selectively operating the fuel injector based on the air fuel ratio error.

10. The device according to claim 9, further comprising:

first and second function blocks operatively associated with the controller, said controller adapting a pulse duration of the fuel injector based on an output from at least one of the first and second function blocks.

11. The device according to claim 10, further comprising:

an adaptation matrix provided in the at least one function block, said adaptation matrix including individual combinations of operational parameters regarding a required fuel amount and injection pressure for a particular engine, said function block calculating a correction factor based on the adaptation matrix and said controller selectively controlling the pulse duration of the fuel injector based upon the correction factor.

* * * * *